United States Patent [19]

Scott

[11] 3,992,886

[45] Nov. 23, 1976

[54] IRRIGATION GRAVEL GUARD AND CLEAN-OUT MEANS THEREFOR

[76] Inventor: Robert A. Scott, 1427 Newcastle Road, No. 122, Grand Island, Nebr. 68801

[22] Filed: Apr. 23, 1976

[21] Appl. No.: 679,856

[52] U.S. Cl. ..... 61/12; 61/63; 210/445; 210/446

[51] Int. Cl.[2] ..... E02B 13/00

[58] Field of Search ..... 61/10–13, 61/63; 210/445, 446

[56] References Cited

UNITED STATES PATENTS

| | | | |
|---|---|---|---|
| 680,096 | 8/1901 | West | 210/445 X |
| 1,768,310 | 6/1930 | Erickson | 61/12 |
| 2,370,668 | 3/1945 | Johnson | 210/445 X |
| 2,384,057 | 9/1945 | Wetherell | 210/445 X |
| 2,515,600 | 7/1950 | Hayes | 61/12 X |
| 2,530,283 | 11/1950 | Brown | 210/445 X |
| 2,761,529 | 4/1956 | Wisenbaugh | 210/446 X |
| 2,835,391 | 5/1958 | Bottum | 210/445 X |
| 3,063,566 | 11/1962 | Hanley | 210/446 X |
| 3,280,982 | 10/1966 | Barto | 210/446 X |
| 3,794,180 | 2/1974 | Blocker | 210/445 |

*Primary Examiner*—Dennis L. Taylor
*Attorney, Agent, or Firm*—Zarley, McKee, Thomte & Voorhees

[57] ABSTRACT

An irrigation pipe comprising a first elongated pipe portion, an intermediate pipe portion which extends at an angle from one end of the first pipe portion, and a second pipe portion extending from the intermediate pipe portion parallel to the first pipe portion. The ends of the first and second pipe portions are adapted to be connected to other irrigation pipes. A hollow tubular member is secured to the intermediate pipe portion and extends outwardly therefrom and is aligned with the central longitudinal axis of the first pipe portion. The interior of the tubular member is in communication with the interior of the intermediate pipe portion. A gravel screen is positioned in the first pipe portion and is substantially conical in shape with one end thereof being substantially equal in diameter to the interior of the first pipe portion. A pipe stub is secured to the other end of the gravel screen and extends therefrom through the tubular member in a sealed relationship with respect thereto. A valve or the like is provided on the outer end of the pipe stub to permit the gravel collected by the interior of the gravel screen to be flushed therefrom outwardly through the pipe stub.

6 Claims, 5 Drawing Figures

IRRIGATION GRAVEL GUARD AND CLEAN-OUT MEANS THEREFOR

BACKGROUND OF THE INVENTION

This invention relates to a gravel guard or screen and more particularly to a gravel guard for use in irrigation pipes which prevents gravel or the like from flowing through the pipe so as to prevent clogging of the sprinkler heads. More particularly, this invention relates to a means for flushing or removing the gravel from the interior of the screen without the necessity of separating the pipe sections.

Various types of gravel guards or screens have been provided but the cost of manufacturing the same has greatly decreased the desirability thereof. Additionally, certain types of the existing gravel screens seriously restrict the flow of water through the pipe.

In applicant's co-pending application, Ser. No. 505,610 filed Sept. 12, 1974, a gravel guard was disclosed for insertion in the irrigation pipes to remove the gravel from the water flowing therethrough. While the gravel screen of the co-pending application has been successful, it has been found that it was necessary to periodically separate the pipe sections to permit the screen to be removed therefrom so that the gravel collected thereby could be removed therefrom. The requirement that the pipe sections be separated involves considerable time and labor.

Therefore, it is a principal object of the invention to provide an improved irrigation gravel guard and clean-out means therefor.

A further object of the invention is to provide an irrigation gravel guard which may be cleaned without the necessity of separating the irrigation pipe sections.

A still further object of the invention is to permit an irrigation gravel guard which does not undesirably restrict the flow of water therethrough.

A further object of the invention is to provide a gravel guard which may be produced economically.

A further object of the invention is to provide a gravel guard which is durable in use.

These and other object will be apparent to those skilled in the art.

DESCRIPTION OF THE PREFERRED EMBODIMENT

Figure 1:
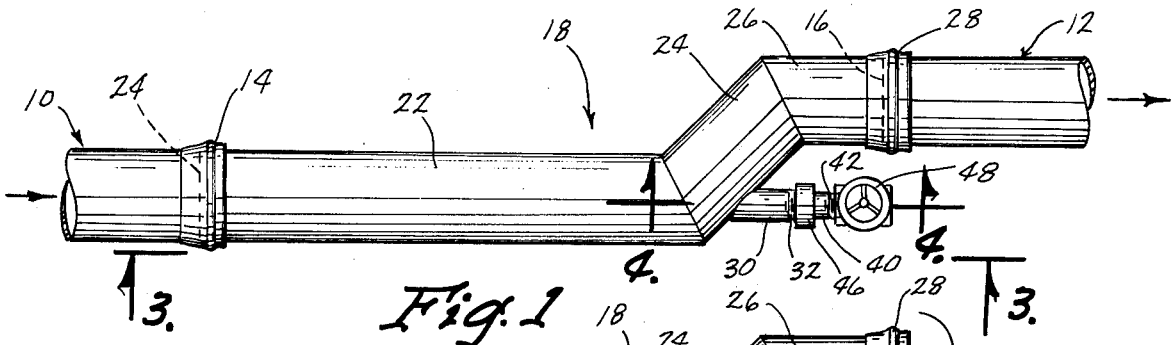
FIG. 1 is a plan view of an irrigation pipe system wherein the device of this invention has been installed therein.
Figure 2:
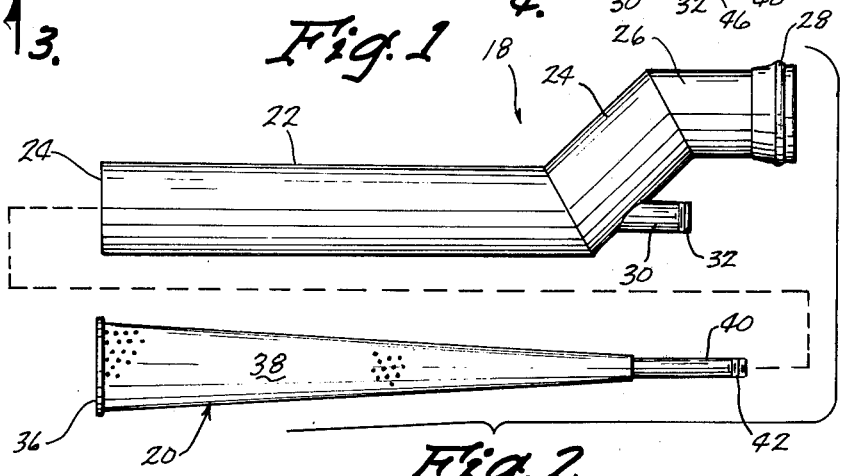
FIG. 2 is a plan view of the device of this invention.
Figure 3:
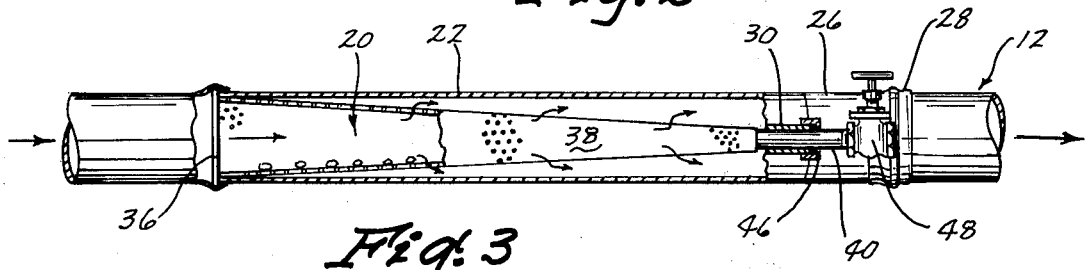
FIG. 3 is a plan view of the screen portion of the invention.
Figure 4:
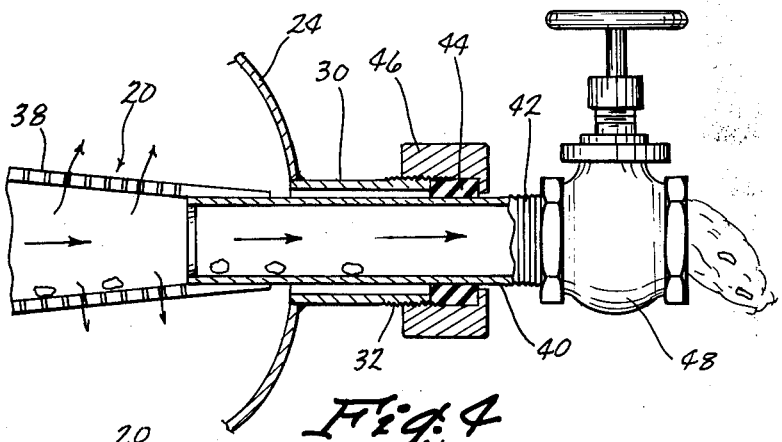
FIG. 4 is a sectional view seen on lines 4—4 of FIG. 1.
Figure 5:
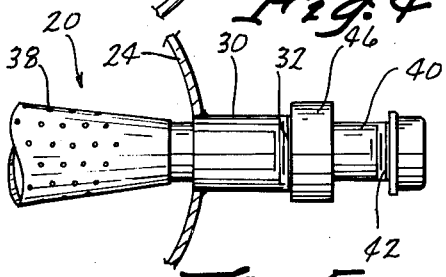
FIG. 5 is a side view illustrating a modified form of the closure means at the end of the gravel screen.

In FIG. 1, the numerals 10 and 12 refer to conventional irrigation pipes used to convey water to sprinkler heads or the like (not shown). Pipe 10 is provided with a typical female end 14 while pipe 12 is provided with a typical male end 16. The device of this invention is referred to generally by the reference 18 and generally comprises a pipe 18 and a gravel screen or guard 20.

Pipe 18 comprises a first elongated pipe portion 22 having an end 24 adapted to be received within end 14 of pipe 10. Intermediate pipe portion 24 extends from the other end of pipe portion 22 at an angle with respect thereto as seen in the drawings. Pipe portion 26 extends from intermediate portion 24 parallel to pipe portion 22 and has an end 28 adapted to receive the end 16 of pipe 12. The configuration of the ends of the pipes 10 and 12 as well as the configuration of the ends of the pipe portions 22 and 24 does not form a part of the invention other than to provide a means for installing the unit 18 in an irrigation pipe system.

The numeral 30 refers to a hollow tubular member secured to intermediate pipe portion 24 and extending outwardly therefrom. Tubular member 30 is provided with threads 32 at the outer end thereof. Tubular member 30 is parallel to pipe portion 22 and is aligned with the center axis of pipe portion 22.

Screen 20 comprises a ring-shaped support 36 and a substantially truncated conical shaped perforated screen member 38 secured thereto. Screen member 38 has a pipe stub 40 secured to one end thereof which extends therefrom in a manner illustrated in the drawings. Pipe stub 40 is provided with threads 42 at the outer end thereof.

When it is desired to install the gravel guard in an irrigation pipe system, pipe 18 is secured to pipes 10 and 12 as illustrated in FIG. 1. Prior to connecting pipe 18 to pipes 10 and 12, screen 20 is inserted into the interior of pipe 18 so that a large majority of the length of the screen 20 is positioned within pipe portion 22 and so that pipe stub 40 extends outwardly through tubular member 30. A packing gland seal 44 embraces pipe stub 40 at the outer end of tubular member 30 and is maintained in position by a cap ring 46 threadably mounted on threads 32 to prevent the escape of water outwardly through tubular member 30 between tubular members 30 and pipe stub 40. The numeral 48 refers to a conventional manually operated valve threadably mounted on threads 42. It should be noted that valve 48 may be replaced by a conventional closure means such as a cap if the expense of a valve is desired to be avoided.

In operation, the water will flow from pipe 10 into pipe portion 22 and into the interior of the gravel screen 20. Preferably, screen 20 is comprised of 20 guage galvanized iron having holes ⅛ inch, 3/32 inch or 1/16 inch in diameter. The difference in hole size of the screens is required because of the different size sprinkler heads ordinarily used in conjunction with the irrigation pipe. Ring-shaped support 36 is preferably constructed of a steel material having a wall thickness of approximately ¼ inch.

The shape of the gravel screen and the perforations thereof are such that the flow of water therethrough is not undesirably affected but the gravel in the water will be trapped in the interior of the guard to prevent the gravel from becoming clogged in the sprinkler heads along the length of the sprinkler pipe. When the screen 20 becomes clogged with gravel, the valve 48 is simply opened which permits the flow of water passing through the pipe to flush or force the gravel in the interior of the screen 20 outwardly through pipe stub 40. If a conventional closure is employed rather than the valve, the closure would simply be removed from the outer end of the pipe stub 40 to permit the flushing of the gravel from the interior of the screen. It should also be noted that the manually operated valve 48 could be replaced with a automatic valve if desired.

Thus it can be seen that a novel means has been provided for removing the gravel from the water flowing through an irrigation pipe which includes means for flushing or removing the gravel from the screen as the screen becomes clogged. The gravel is removed from the screen without the necessity of disconnecting the irrigation pipe sections and may be accomplished in a matter of seconds. Thus it can be seen that the device accomplishes at least all of its stated objectives.

I claim:

1. In combination, an irrigation pipe comprising a first elongated pipe portion having one end for connection to other irrigation pipes, an intermediate pipe portion extending at an angle from the other end of said first pipe portion, and a second pipe portion extending from said intermediate pipe portion parallel to said first pipe portion, said second pipe portion having an end portion for connection to other irrigation pipes, a hollow tubular member secured to said intermediate pipe portion and extending outwardly therefrom, said tubular member being aligned with the central longitudinal axis of said first pipe portion, said tubular member being in communication with the interior of said intermediate pipe portion, a gravel screen positioned in said first pipe portion, said screen being substantially truncated conical in shape and having first and second ends, said first end of said screen being open and having a diameter substantially equal to the interior of said first pipe portion, said second end of said screen having a diameter less than said first end thereof, a pipe stub secured at one end to said second end of said screen and extending therefrom through said tubular member in a sealed relationship thereto, and closure means on the second end of said pipe stub for selective opening of said second end of said pipe stub to permit the gravel in the interior of said screen to be flushed outwardly therefrom through said pipe stub.

2. The combination of claim 1 wherein said closure means comprises a valve means.

3. The combination of claim 2 wherein said valve means comprises an electrically operated valve means.

4. The combination of claim 1 wherein a ring-shaped support is secured to said first end of said screen.

5. The combination of claim 1 wherein a seal means embraces said pipe stub at the outer end of said tubular member.

6. The combination of claim 1 wherein a packing gland means embraces said pipe stub at the outer end of said tubular member.

* * * * *